United States Patent [19]

Isoda

[11] 3,931,722

[45] Jan. 13, 1976

[54] APPARATUS FOR LIQUID TREATMENT OF A CLOTH BAND OF AN ENDLESS FORM

[75] Inventor: Narihiro Isoda, Fukui, Japan

[73] Assignee: Suntex Limited, Fukui, Japan

[22] Filed: May 14, 1973

[21] Appl. No.: 360,302

[30] Foreign Application Priority Data

May 31, 1972 Japan ..... 47-54192

[52] U.S. Cl. ..... 68/176

[51] Int. Cl.[2] ..... D06B 3/24

[58] Field of Search ..... 68/176, 205 E, 175, 177; 242/47.01, 47.08, 47.09

[56] References Cited

UNITED STATES PATENTS

| | | | |
|---|---|---|---|
| 2,539,980 | 1/1951 | Van Hall et al. | 68/205 E X |
| 3,604,224 | 9/1971 | Beasley | 68/176 |

FOREIGN PATENTS OR APPLICATIONS

| | | | |
|---|---|---|---|
| 1,364,870 | 5/1964 | France | 68/205 E |
| 734,150 | 7/1955 | United Kingdom | 68/205 E |

*Primary Examiner*—Harvey C. Hornsby
*Assistant Examiner*—Philip R. Coe
*Attorney, Agent, or Firm*—Larson, Taylor and Hinds

[57] ABSTRACT

Method and apparatus for liquid treatment of a lengthy woven or knitted cloth band of an endless form for scouring, dyeing and desizing of cloths. A cloth band is helically wound on plurality of cylindrical drums disposed axially in longitudinal arrangement with helical parts thereof depending from the cylindrical drums. Rotation of the cylindrical drums at progressively reduced peripheral speeds causes the helical parts of the cloth to depend at uniform lengths from the drums and thereafter all cylindrical durms are rotated at an equal speed.

2 Claims, 10 Drawing Figures

FIG. 6
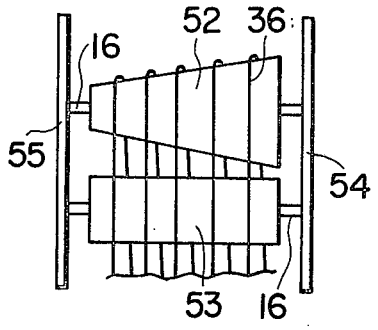
FIG. 7
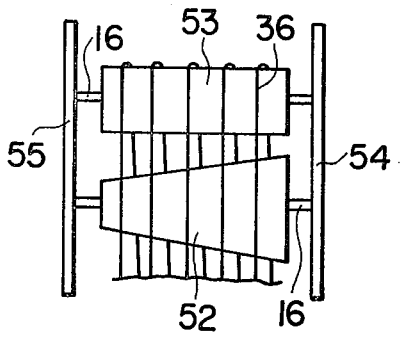
FIG. 8
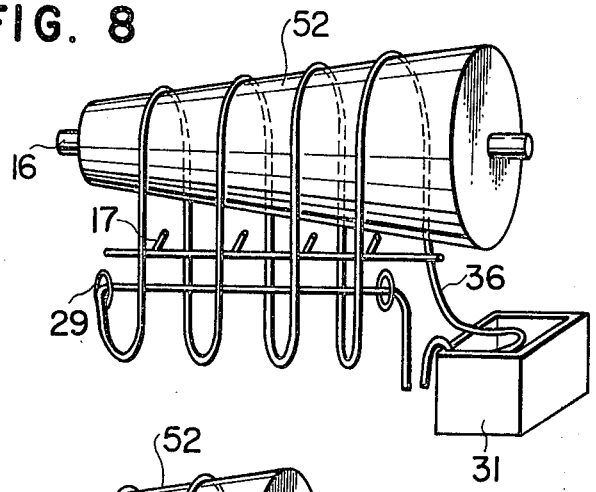
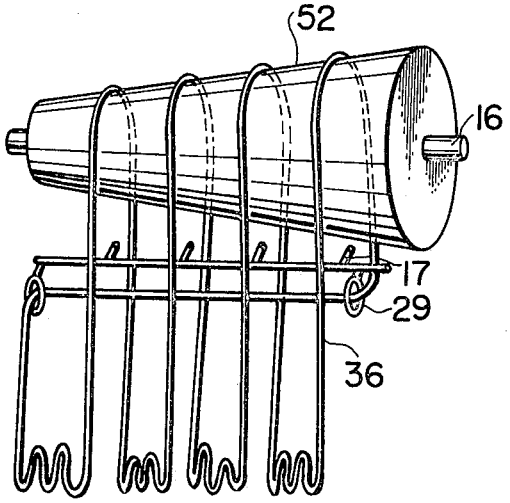
FIG. 9

APPARATUS FOR LIQUID TREATMENT OF A CLOTH BAND OF AN ENDLESS FORM

This invention relates to an apparatus for liquid treatment of a lengthy woven or knitted cloth band of an endless form.

The invention is particularly intended for liquid treating such cloth in a treating liquid for scouring, dyeing and desizing purposes.

According to the apparatus of the invention, a cloth band of a preferred length is provided to helically wind and depend from cylindrical drum which are longitudinally connected and axially mounted on a shaft, such cylindrical drum being rotated at peripheral speeds progressively reduced from one end to other end, wherein each helical part of the cloth band is depended downwardly from drum at a uniform length and thereafter the cylindrical drum are rotated at an equal speed thereby circulating the cloth through a treating liquid in a tub to apply a desired treatment to the cloth band such as scouring, dyeing and desizing.

BACKGROUND OF THE INVENTION

Prior art methods of the kind for liquid treatment of a cloth band included the steps of providing a cloth band of an endless form depended upon a cylindrical drum, suspending the cloth band from the drum and passing it repeatedly through a treating liquid in a tub below the cylindrical drum. One usual method was provided such that a cloth band of a preferred length and in endless connection is depended from the cylindrical drum, the depending lower part of the cloth band being dipped in a treating liquid in a treating tub, thereafter the cylindrical drum are rotated to permit the cloth band depended from the drum to pass through the treating liquid continuously. The method as described however is very cumbersome and therefore not desirable for use because separate cloth bands must be prepared in a large number to meet the need and much troubles are entailed from the necessity of suspending each cloth band on the drum or removing each used cloth band from the drum.

In alternate case, the cloth band was formed in a lengthy band with the ends connected to each other, the connected cloth band being helically depended from the drum with the lower parts drooping in a loose condition. The lower parts of the cloth band helically depending are dipped in a treating liquid. The cylindrical drum is then rotated in the similar way to treat the cloth band in like manner as described in the first example.

According to the above prior art methods, the cloth band may be taken out of the tub after treatment but as the entire band is formed in a serial connection, it is rather convenient for drawing out the cloth band from the tub simply by disconnecting the joints of ends of the cloth band so that the cloth band can be readily taken out continuously from the drum and also from the treating tub. However the suspension of the cloth band helically on the cylindrical drum so as to get uniform lengths of dipped parts in the treating liquid or of parts drooping from the drum to be dipped in the treating liquid in a loosened way has been a difficult problem to solve.

BRIEF SUMMARY OF THE INVENTION

The invention provides an apparatus for liquid treatment of a lengthy woven or knitted cloth band of an endless form for scouring, dyeing and desizing purposes. Normally the cylindrical drums are consisted of one or more drum members having same diameters mounted on a same shaft and arranged axially in a longitudinal connection. On the cylindrical drums is wound a cloth band which may be helically suspended downwardly of the drums with a number of helical parts of the cloth band depended from the cylindrical drums. By rotation of the cylindrical drums with the peripheral speeds progressively reduced from a first drum toward a last one, each helical part of the cloth band may depend downwardly at a uniform length. All cylindrical drums in serial connection are rotated at equal speeds thereafter.

It is a primary object of the invention to provide an apparatus for liquid treatment of a lengthy cloth band of woven or knitted material for scouring, dyeing and desizing purposes, which apparatus is simple and efficient for practice and brings no troubles in charging the cloth band and treating and drawing out the product.

It is a further object of the invention to provide a novel mechanism for use in the apparatus for liquid treatment of a lengthy cloth band of woven or knitted material for scouring, dyeing and desizing, which can apply a desired uniform treatment for the manufacture of a product before charging a material cloth band, that is, in the initial stage of liquid treatment.

It is a further object of the invention to provide a novel mechanism most adapted for the apparatus for liquid treatment of a lengthy cloth band of woven or knitted material which can apply an equal speed to the cylindrical drum after a material cloth is charged onto the cylindrical drum which are uniform in shape and suited for manufacture of a product.

It is an additional object of this invention to provide an apparatus for liquid treatment of a lengthy cloth band of woven or knitted material, which has a simple and efficient construction.

These and other objects and advantages of the invention will be achieved by application of the mechanism and also by the process and operation of the apparatus of the present invention, of which specific embodiments of the invention will be illustrated with reference to the accompanying drawings, in which:

BRIEF DESCRIPTION OF THE DRAWINGS

FIGS. 6 and 7 are other embodiments of the apparatus of this invention illustrating the apparatus in practical use;

FIG. 8 is a view of FIG. 6 illustrating the condition of a lengthy cloth band in the initial stage of operation;

FIG. 9 is a view illustrating a preferred example of treatment of a lengthy cloth band of FIG. 6.

DETAILED DESCRIPTION OF THE INVENTION

Figure 1:
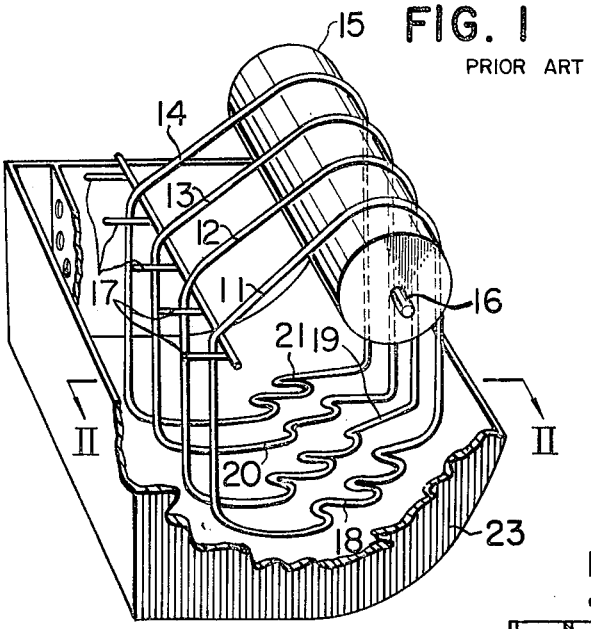
FIG. 1 PRIOR ART
FIG. 1 is a perspective view of an example of a conventional apparatus showing a part thereof being cut away.
Figure 2:
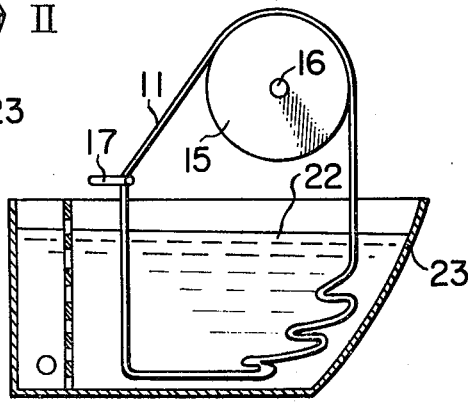
FIG. 2 PRIOR ART
FIG. 2 is a cross section taken along the line II—II of FIG. 1.

Previous to illustration of an embodiment of the invention, one example of the prior art technique is now described with reference to FIG. 1. In the drawing, a preferred number of cloth bands, 11, 12, 13 and 14 are shown connected in an endless form and arranged to be depended in parallel from a longitudinal cylindrical drum 15 axially mounted on a shaft 16. A guide plate 17 is provided for guiding the cloth band. Each cloth band 11, 12, 13 and 14 has a downwardly drooping part 18, 19, 20 and 21, which is arranged to dip in a treating liquid 22 (shown in FIG. 2) of a treating tub 23. The cylindrical drum 15 is rotated to continuously pass over the cloth bands 11, 12, 13 and 14 through the treating liquid 22. This type of the conventional apparatus is required a number of endless cloths, each of which is suspended from the cylindrical drum 15 as shown and removed from the drum after it is treated with liquid. It has been found that this treating operation has been extremely troublesome in practice. A cross section of the apparatus taken along the line II—II of FIG. 1 is shown in FIG. 2.

Figure 3:
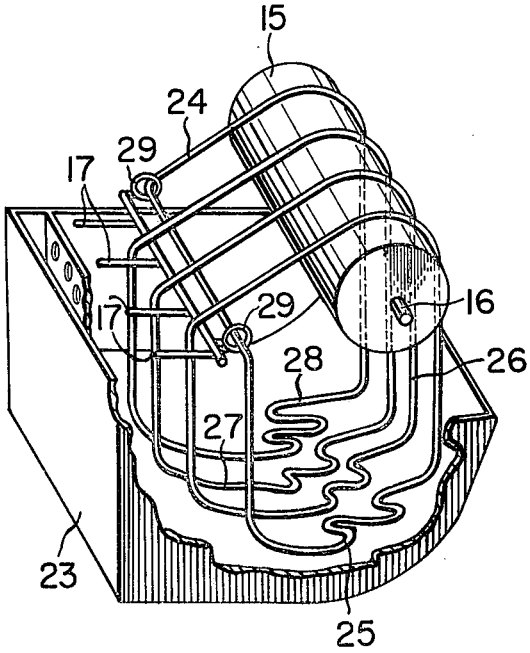
FIG. 3 PRIOR ART
FIG. 3 is a perspective view of other example of a prior art apparatus showing a part thereof being cut away.

Another example of the prior art technique is shown in FIG. 3, in which ends of a cloth are previously connected for subsequent treatment. The cloth band is formed in a lengthy endless band 24, the lower part of which is loosened and helically applied on the cylindrical drum 15. The loosened lower parts 25, 26, 27 and 28 are dipped in the treating liquid. By rotation of the cylindrical drum 15, the endless band 24 is passed through the treating liquid. As shown in the drawing, a guide ring 29 is provided for the endless band. In the apparatus of the type, the endless band is taken out of the cylindrical drum and treating means after treatment is carried out in a manner different from that of the apparatus shown in FIGS. 1 and 2. The entire cloth band is formed in a serial connection, which cloth can be taken out all in succession in a relatively simple way. When one of the connection parts of the cloth band is detached from other and one end of the detached cloth is pulled out, the cloth can be pulled out continuously very simply and conveniently. In this occasion, however, it is quite difficult to preferably helically put the cloth band in endless connection upon the cylindrical drum 15 so that the lower parts 25, 26, 27 and 28 of the cloth band each depending in the treating liquid may have substantially uniform lengths. It is essentially important though to provide an arrangement of cloth bad depending at uniform lengths and substantially helically wound on the cylindrical drum.

Figure 4:
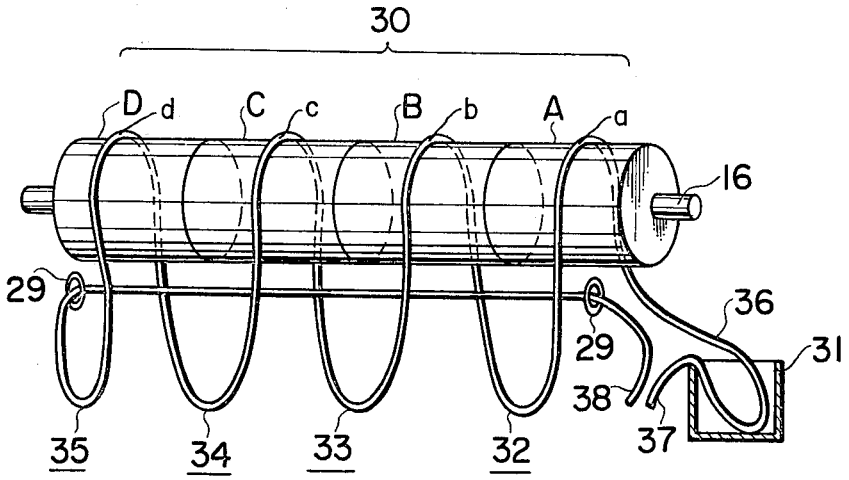
FIG. 4 is a view illustrating an essential portion of the apparatus according to the invention.

The present invention has eliminated the above-mentioned drawbacks of the prior arts as shown in FIG. 3. In the first embodiment of the invention, as shown in FIG. 4, the apparatus is consisted of composite cylindrical drum 30 which is longitudinally connected and disposed on a same shaft 16, which composite cylindrical drum consisting of a number of cylindrical drum members each having a same diameter. The composite cylindrical drum 30 thus being formed in a serial connection, each drum may have a peripheral speed of a preferred ratio of rotation relative to the rotation of other drums. Thus, the drums may respectively be rotated at progressively reduced peripheral speeds from a first drum A through a last one D, that is, from the nearest drum A through the farthest drum D relative to a housing 31. The cloth band in serial connection and contained in the housing 31 can be drawn out of the housing and put on the serially connected drums having each helical part of the cloth band depending from each and one cylindrical drum. In this arrangement, the cylindrical drums may be rotated respectively at various peripheral speeds in the order of progressively reduced ratios as preferred. After rotation of the drums in a certain period of time, there may be obtained cloth bands of uniform lengths with loosened parts 32, 33, 34 and 35 of a lengthy cloth band 36 depending from the drums A, B, C and D. In this occasion, two ends 37 and 38 of the lengthy cloth band as shown in FIG. 4 are connected in an endless form. Preferably the connected cloth band may be formed endless in shape before it is suspended from each drum.

Thus, the drums may be rotated at the same peripheral speeds. It will result that each part of the cloth band on each drum will droop from the drum having a preferred form always in continuity.

Below is illustrated an example of a mechanism with reference to FIG. 5 which is employed for varying the speed of each drum mounted on a shaft for all drums in connection.

The drawing shows for illustration a combination of two small cylindrical drums A and B formed into a composite cylindrical drum 30. In FIG. 5 is shown a drum A located closest to the housig 31 of FIG. 4 and secured to a shaft 16, which shaft is journalled on bearings 39 and 40. On the shaft 16 is mounted a rotary sprocket wheel 41. A chain 42 is provided between the rotary sprocket wheel 41 and a first driving sprocket wheel 43 attached to one end of a drive shaft 44 as separately provided. The shaft 16 is rotated through rotation of the drive shaft 44. A clutch 45 is provided on a shaft 16 to slidably move to left and right. The drum B may be located adjacent to the drum A on the shaft 16, an internal drum 46 is rotatably attached to the shaft 16, which internal drum 46 is secured with the drum B. The internal drum 46 is further attached with a rotary sprocket wheel 47, which is connected by chain 48 to a second driving sprocket wheel 49 fixed to other end of the drive shaft 44. It will be seen that the rotary sprocket wheel 47 of the second drum B has a diameter relatively larger than that of the rotary sprocket wheel 41 of the first drum A. The two driving sprocket wheels 43 and 49 as described and mounted on the drive shaft 44 have the same diameter. The second driving sprocket wheel 49 which rotates the second drum B may preferably be provided with a freewheel means (not shown).

A pawl 50 is provided on an outer side of the rotary sprocket wheel 47 of the second drum B, which pawl is located opposite to the engaging part 51 of the clutch 45 as above described.

Operation of the mechanism according to the invention is now described.

When the drive shaft 44 is rotated, the first and second drums A and B are rotated and at this moment the second drum B is rotated slower than the first drum A.

Thereafter, the lengthy cloth band 36 of the lower part of each drum having equal loosening and being dipped in the treating liquid.

Figure 5:
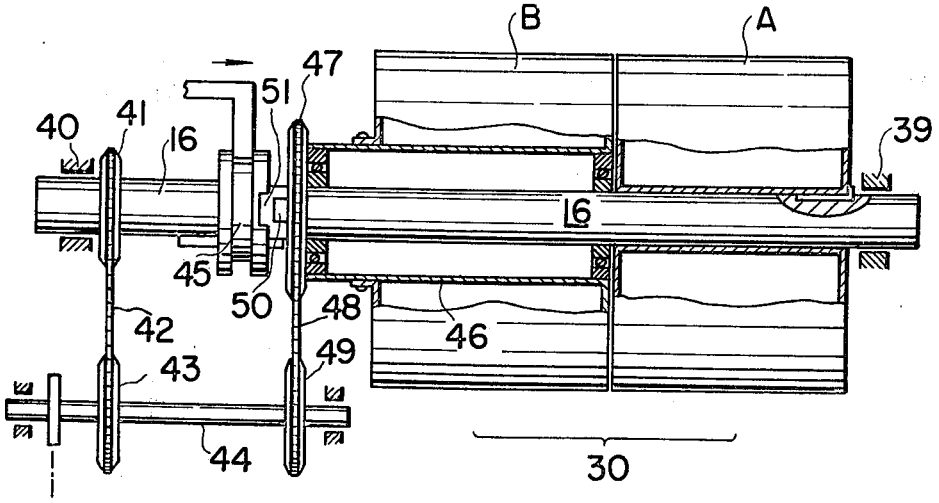
FIG. 5 is a front view of a preferred mechanism used in the apparatus of the invention, showing its cross section being partly cut away.

During this operation, the clutch 45 is moved as in FIG. 5 to the right (as shown by the arrow). Then an engaging part 51 is engaged to a pawl 50 of the rotary sprocket wheel 47 of the drum B to transmit the rotation of the shaft 16 to the drum B which was rotating at a lower speed relative to the drum A so that the first and second drums A and B are integrally and simultaneously rotated.

The rotary sprocket wheel 47 giving rotation to the second drum B is idly rotated by the freewheel of the second driving sprocket wheel 49 as above described.

This embodiment provides such that the first, second and third small drums of the same diameter may be mounted in parallel on the same shaft. It is also provided that the small drum located farther from the housing 31 relative to other small drums on the same axis is so much reduced in frequency of rotation and when lengths of dependency of the cloth bands from respective small drums become equal, rotation of the small drums becomes equal.

In another case shown in FIG. 6, a cylindrical drum 52 of a known cone-shape is located in the upper part and a cylindrical drum 53 of a right shape is provided below in parallel to the abovementioned cone-shaped cylindrical drum. Each shaft 16 on which each drum is carried by support frames 54 and 55 is provided in vertical direction of the shaft 16.

In this arrangement, the lengthy cloth band 36 leading from the housing 31 is brought to a large diameter part of the cone-shaped cylindrical drum 52, the cloth band then being successively wound helically on the drum rotating at a preferred frequency of rotation. As the result, the depending portion of the cloth band is produced a loosening of an approximately same length while staying in the treating liquid. Then, as shown in FIG. 7, the support frames 54 and 55 are turned over with the upper support frame changed for the lower support frame. The portion which has been depended on the cone-shaped cylindrical drum 52 is moved to the right shaped cylindrical drum 53. Liquid treatment is thus carried out by rotation of this right shaped cylindrical drum. FIG. 8 shows the cone-shaped cylindrical drum 52 depending the lengthy cloth band 36 in the initial stage of liquid treatment. FIG. 9 illustrates the lengthy cloth band 36 in a preferred proper condition of treatment.

Figure 10:
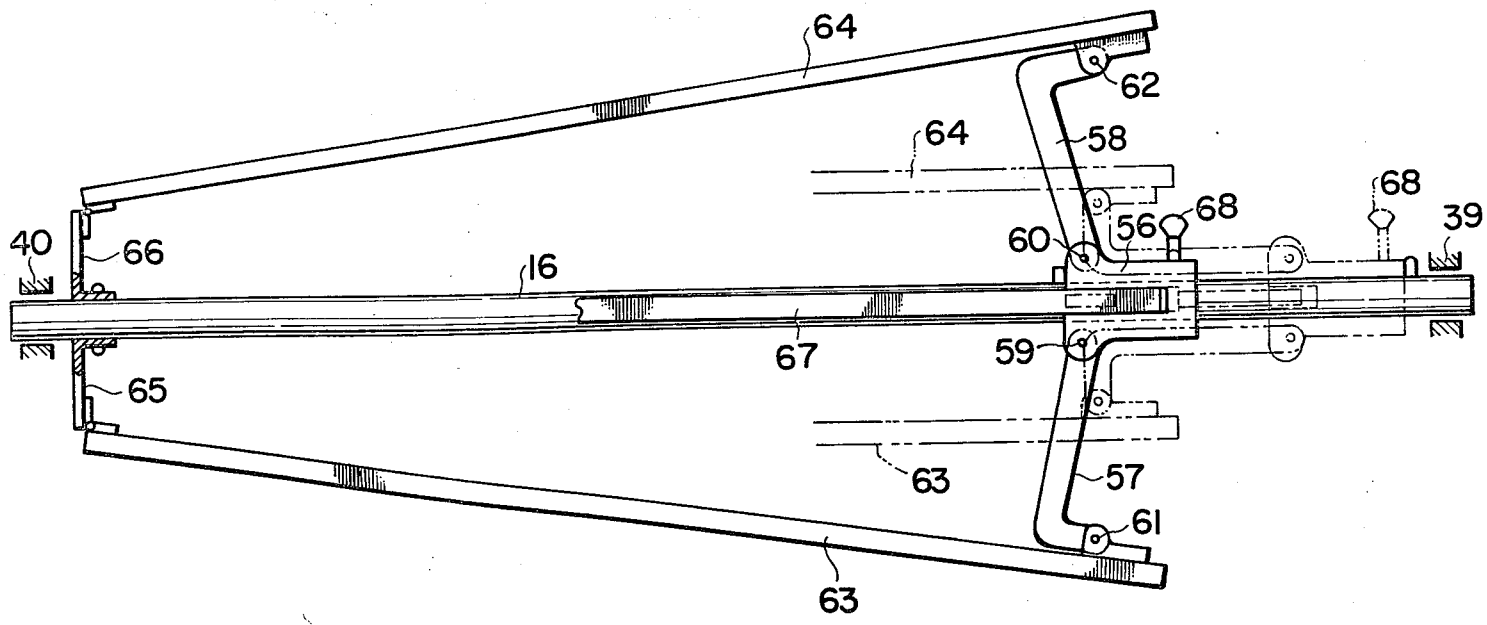
FIG. 10 is a front view showing other construction of the cylindrical drum according to the invention.

FIG. 10 shows a mechanism of an essential portion of another embodiment. In the mechanism, the shaft 16 is journalled on bearings 39 and 40, the shaft being slidably fitted with the slidable member 56 on which arms 57 and 58 are provided are rotatably carried at ends by pins 59 and 60 with other ends of the arms 57 and 58 rotatably connected by pins 61 and 62 to ends of frame bars 63 and 64. The ends of the frame bars 63 and 64 are attached free to open or close to supports 65 and 66 so designed as to allow the ends of the frame bars 63 and 64 to open outwardly larger than other ends of the frame bars relative to the shaft 16 when the arms 57 and 58 are turned to vertical as shown. The frame bars 63 and 64 are provided several in number surrounding the shaft 16 (the other frame bar is partly shown at 67 in a cutaway view of FIG. 10).

Thus, when the arms 57 and 58 are turned to vertical, there is produced a same configuration as that of the cone-shaped cylindrical drum 52 as shown in FIGS. 6, 7, 8 and 9. The lengthy cloth band leading from the housing 31 is then depended from the cone formed by the above described frame bars successively from a large diameter portion to a smaller one of the cone. When the lengths of loosened parts in the lower part of the cloth band becomes equal to each other, the slidable member 56 is drawn out (shown on the right) and the frame bars are mounted in parallel on the shaft 16 with the slidable member rigidly fixed to the shaft 16 by a set screw 68. As shown in the drawing, outer configuration formed by the frame bars parallel to the shaft 16 have same diameters both in the front and rear parts, which configuration is similar to that of the cylindrical drum of the right cylindrical shape (as shown in FIGS. 6 and 7). In this position, the shaft 16 is rotated to carry out the liquid treatment as desired for the cloth band.

The above-mentioned mechanism does not need the provision of two cylinders of conical and right cylindrical shape as shown in FIGS. 6 and 7. This gives much convenience for the treatment operation.

As many apparently widely different embodiments of this invention may be made without departing from the spirit and scope thereof, it is to be understood that the invention is not limited to the specific embodiments thereof except as defined in the appended claims.

What is claimed is:

1. An apparatus for liquid treatment of a lengthy woven or knitted cloth band for scouring, dyeing and desizing of cloths, comprising a plurality of drums rotatably mounted on a common shaft about which drums said cloth band is helically wound, a treating tub beneath said drums for said treatment, means for rotating said drums at progressively reduced peripheral speeds from one end to the other in order to depend each helical part of the cloth band downwardly from the drums at a uniform length and means for rotating drums at an equal speed thereby circulating the cloth band through the treating liquid in said tub to apply the desired treatment, said means for rotating the drums at an equal speed having a relationship with the means for rotating the drums such that the equal speed takes place after the results of the reduced peripheral speeds are achieved.

2. An apparatus for liquid treatment of a lengthy woven or knitted cloth band for scouring, dyeing and desizing of cloths, comprising a number of drums of a same diameter mounted and arranged adjacent to each other on a common shaft, means for rotating said drums successively at lower speeds in the order of sequence from a first drum to a last drum and also means for rotating all drums in the same direction at the same speed, the latter means being provided with a drive shaft in parallel with the shaft mounting said number of drums, said drive shaft being provided with driving sprocket wheels of the same diameter, said driving sprocket wheels transmitting power to rotary sprocket wheels on said shaft with said first drum fixed directly on said shaft and said first drum is rotatable with said shaft, an internal drum being rotatably mounted on said shaft with the second drum secured to the internal drum to make an adjacent drum to succeed said first drum to rotate, said internal drum having a rotary sprocket wheel larger in diameter than the rotary sprocket wheel rotating said first drum, said rotary sprocket wheel having power transmitted thereto from a separate driving sprocket wheel having a free wheel and mounted on a drive shaft, transmission means or a clutch meshing with a pawl on the rotary sprocket wheel for the internal drum, and a treating tub placed beneath the drums for dyeing treatment, wherein the lengthy cloth band depends helically from the drums with each drooping portion in the tub as the drums are rotated in the same direction at progressively reduced speeds from the first part to the last one so that loosened portions of the lengthy cloth band may form a uniform length when the band cloth is placed in the tub as the drums are rotated in the same direction and same speed.

* * * * *

UNITED STATES PATENT OFFICE

CERTIFICATE OF CORRECTION

Patent No. 3,931,722 Dated January 13, 1976

Inventor(s) Norihiro Isoda

It is certified that error appears in the above-identified patent and that said Letters Patent are hereby corrected as shown below:

On the Cover Sheet, in item [75]

"Narihiro" should read -- Norihiro --.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*